US009890980B2

(12) United States Patent
Peitz et al.

(10) Patent No.: US 9,890,980 B2
(45) Date of Patent: Feb. 13, 2018

(54) SYSTEM AND METHOD OF FREEZE PROTECTION OF A HEAT EXCHANGER IN AN HVAC SYSTEM

(71) Applicant: Carrier Corporation, Farmington, CT (US)

(72) Inventors: Robert W. Peitz, Fishers, IN (US); Brian L. Merkel, Lafayette, IN (US); Paul B. Kiningham, Roanoke, IN (US)

(73) Assignee: Carrier Corporation, Jupiter, FL (US)

( * ) Notice: Subject to any disclaimer, the term of this patent is extended or adjusted under 35 U.S.C. 154(b) by 789 days.

(21) Appl. No.: 14/337,404

(22) Filed: Jul. 22, 2014

(65) Prior Publication Data

US 2015/0082818 A1 Mar. 26, 2015

Related U.S. Application Data

(60) Provisional application No. 61/882,918, filed on Sep. 26, 2013.

(51) Int. Cl.

| | |
|---|---|
| ***F25D 17/06*** | (2006.01) |
| ***F28B 9/00*** | (2006.01) |
| ***F25B 49/00*** | (2006.01) |
| ***F25B 41/04*** | (2006.01) |
| ***F25B 1/00*** | (2006.01) |

(Continued)

(52) U.S. Cl.

CPC ..... *F25B 47/006* (2013.01); *F25B 49/02* (2013.01); *F25B 13/00* (2013.01); *F25B 2313/029* (2013.01); *F25B 2313/0293* (2013.01); *F25B 2313/0294* (2013.01); *F25B 2313/0314* (2013.01); *F25B 2600/23* (2013.01); *F25B 2700/2103* (2013.01)

(58) Field of Classification Search

CPC ..... F25B 13/00; F25B 2313/029; F25B 2313/0293; F25B 2313/0314; F25B 2600/23; F25B 2700/2103; F25B 47/006

USPC ..... 62/172, 176.3, 225, 227, 93; 700/276, 700/702

See application file for complete search history.

(56) References Cited

U.S. PATENT DOCUMENTS

| | | | |
|---|---|---|---|
| 3,938,348 | A | 2/1976 | Rickert |
| 4,003,729 | A | 1/1977 | McGrath |

(Continued)

FOREIGN PATENT DOCUMENTS

| | | | |
|---|---|---|---|
| EP | 0676603 | A2 | 10/1995 |
| WO | 2013075080 | A1 | 5/2013 |

*Primary Examiner* — Henry Crenshaw

(74) *Attorney, Agent, or Firm* — Ice Miller LLP

(57) ABSTRACT

A system and method of heat exchanger freeze protection for an HVAC system by operating an indoor unit assembly and an outdoor unit assembly in a cooling mode and operating a fan at an initial airflow, operating a temperature sensor to measure a temperature value of a heat exchanger, at the expiration of a first predetermined time period, determining whether the temperature value is less than or equal to a first temperature preset value, determining whether a current airflow multiplier is equal to a maximum airflow multiplier limit, increasing the current airflow by an airflow offset multiplier if the current airflow multiplier is less than or equal to the maximum airflow multiplier limit and the temperature value is less than or equal to the first temperature preset, and operating the fan at an increased airflow to move more air across the heat exchanger.

49 Claims, 3 Drawing Sheets

(51) Int. Cl.

| | |
|---|---|
| ***G01M 1/38*** | (2006.01) |
| ***F25B 47/00*** | (2006.01) |
| ***F25B 49/02*** | (2006.01) |
| *F25B 13/00* | (2006.01) |

(56) References Cited

U.S. PATENT DOCUMENTS 4,257,238 A * 3/1981 Kountz ..... F24F 11/0009 62/176.3
4,293,029 A * 10/1981 Godard ..... F24D 11/02 165/240
4,831,833 A 5/1989 Duenes et al.
5,065,593 A * 11/1991 Dudley ..... F25D 21/006 62/156
5,170,635 A 12/1992 Wruck et al.
5,475,986 A * 12/1995 Bahel ..... F24F 1/00 236/51
5,653,428 A * 8/1997 Dufour ..... B65H 29/40 270/21.1
5,769,314 A 6/1998 Drees et al.
5,810,245 A 9/1998 Heitman et al.
6,035,649 A * 3/2000 Straub ..... B60H 1/3207 236/44 A
7,836,707 B2 11/2010 Puranen et al.
2002/0148240 A1* 10/2002 Lawrence ..... A47F 3/0482 62/156
2003/0059730 A1 3/2003 Sigafus et al.
2004/0261448 A1* 12/2004 Nishijima ..... F25B 41/00 62/500
2005/0235664 A1* 10/2005 Pham ..... F04C 28/00 62/126
2005/0278071 A1 12/2005 Durham
2008/0022704 A1* 1/2008 Fukuta ..... B60H 1/321 62/172
2008/0179408 A1 7/2008 Seem
2008/0307803 A1 12/2008 Herzon
2010/0070085 A1 3/2010 Harrod et al.
2010/0107070 A1* 4/2010 Devineni ..... B60H 1/00985 715/702
2016/0201934 A1* 7/2016 Hester ..... F24F 11/006 700/276

* cited by examiner

SYSTEM AND METHOD OF FREEZE PROTECTION OF A HEAT EXCHANGER IN AN HVAC SYSTEM

CROSS REFERENCE TO RELATED APPLICATIONS

The present application is related to, and claims the priority benefit of, U.S. Provisional Patent Application Ser. No. 61/882,918 filed Sep. 26, 2013, the contents of which are hereby incorporated in their entirety into the present disclosure.

TECHNICAL FIELD OF THE DISCLOSED EMBODIMENTS

The presently disclosed embodiments generally relate to heating, ventilation, and air-conditioning (HVAC) systems, and more particularly, to a system and method of freeze protection of a heat exchanger in an HVAC system.

BACKGROUND OF THE DISCLOSED EMBODIMENTS

Generally, HVAC systems increase their overall efficiency by closely matching airflow to the refrigerant system capacity. Generally, lower airflows, such as approximately 325 cubic feet per minute (CFM) per ton, yield a higher seasonal energy efficiency ratio (SEER) due to lower electrical consumption of the fan. Open-loop airflow control systems, such as a permanent split capacitor to name one non-limiting example, lose airflow performance at high system static pressures. In order to avoid freezing of the heat exchanger, the open-loop control systems generally require higher airflows, such as approximately 400 CFM/ton, when filters clog, registers are obstructed, etc. There is, therefore, a need for a system and method to increase SEER efficiencies in an open-loop airflow control system while avoiding the possibility of a heat exchanger freezing.

SUMMARY OF THE DISCLOSED EMBODIMENTS

In one aspect, a HVAC system is provided. The HVAC system includes an indoor unit assembly, operably coupled to an outdoor unit assembly. The HVAC system further includes a controller operably coupled to the indoor unit assembly and the outdoor unit assembly.

In one embodiment, the indoor unit assembly includes a heat exchanger, including a suction port and a liquid port, generally associated with a refrigerant medium, but may be associated with any medium used to reduce a temperature of the heat exchanger. The indoor unit assembly further includes a fan configured to circulate air across the heat exchanger into an interior space. The indoor unit assembly further includes a temperature sensor operably coupled to the heat exchanger. In one embodiment, the temperature sensor is affixed to the suction port. In one embodiment, the indoor unit assembly may be an air handler. In another embodiment, the indoor unit assembly may be a furnace in combination with an evaporator coil. In one embodiment, the outdoor unit assembly may be an air conditioner. In another embodiment, the outdoor unit assembly may be a heat pump.

In one aspect, a method of heat exchanger freeze protection for an HVAC system is provided. In one embodiment, the method includes the step of operating the indoor unit assembly and the outdoor unit assembly in a cooling mode, and operating the fan at an initial airflow.

In one embodiment, the method includes the step of operating the temperature sensor to measure a temperature value of the heat exchanger, at a time period. In one embodiment, the time period is adjustable. In one embodiment, the time period is less than or equal to approximately five minutes.

In one embodiment, the method includes the step of determining whether the temperature value is less than or equal to a first temperature preset value and whether the temperature value is greater than or equal to a second temperature preset value. In one embodiment, the first temperature preset value and the second temperature preset value are adjustable. In one embodiment, the first temperature preset value is less than or equal to approximately 35 degrees Fahrenheit (F.). In one embodiment, the second temperature preset value is greater than or equal to approximately 37 degrees F.

In one embodiment, the method includes the step of determining whether a current airflow multiplier is equal to a maximum airflow multiplier limit and equal to a minimum airflow multiplier limit. In one embodiment, the maximum airflow multiplier limit and the minimum airflow multiplier limit are adjustable. In one embodiment, the maximum airflow multiplier limit is greater than or equal to approximately 1.50. In one embodiment, the minimum airflow multiplier limit is less than or equal to approximately 1.00.

In one embodiment, the method includes the step of increasing the current airflow multiplier by an airflow offset if the current airflow multiplier is not equal the maximum airflow multiplier limit and the temperature value is less than or equal to the first temperature preset value. In one embodiment, the method includes, decreasing the current airflow multiplier by the airflow offset if the current airflow multiplier is not equal to the minimum airflow multiplier limit and the temperature value is greater than or equal to the second temperature preset value. In one embodiment, the offset airflow multiplier is adjustable. In one embodiment, the airflow offset is approximately 0.05.

In one embodiment, the method includes the step of operating the fan at an increased airflow determined by the formula: Current Airflow=Initial airflow×(Current airflow multiplier+airflow offset). In one embodiment, the method includes the step of operating the fan at a decreased airflow determined by the formula: Current Airflow=Initial airflow×(Current airflow multiplier−airflow offset).

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
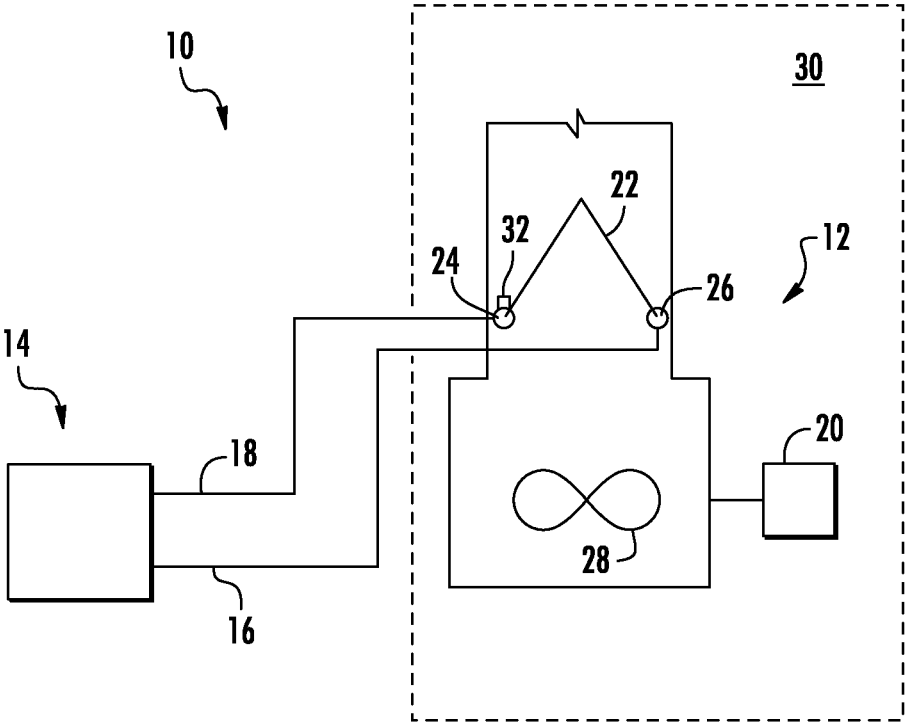
FIG. 1 is a component diagram of an HVAC system according to the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a HVAC system, generally referenced at 10. The HVAC system 10 includes an indoor unit assembly 12. The HVAC system 10 further includes an outdoor unit assembly 14 operably coupled to the indoor unit assembly 12 via a suction line 18 and a liquid line 16. The HVAC system 10 further includes a controller 20 operably coupled to the indoor unit assembly 12 and the outdoor unit assembly 14 for the control thereof. It will be appreciated the controller 20 may be disposed within either the indoor unit assembly 12 or the outdoor unit assembly 14. It will also be appreciated the controller 20 may be a thermostat.

In one embodiment, the indoor unit assembly 12 includes a heat exchanger 22 including a suction port 24 and a liquid port 26. In one embodiment, the suction port 24 is coupled to the suction line 18 and the liquid port 26 is coupled to liquid line 16. The indoor unit assembly 12 further includes a fan 28 configured to circulate air across the heat exchanger 22 into an interior space 30. The indoor unit assembly 12 further includes a temperature sensor 32 operably coupled to the heat exchanger 22. In one embodiment, the temperature sensor 32 is affixed to the suction port 24 of the heat exchanger 22. For example, the temperature sensor 32 may be affixed to the suction port 24 of the heat exchanger 22 for ease of access by installation and service personnel. It will be appreciated that the temperature sensor 32 may be affixed to the liquid port 26 or on the heat exchanger 22. In one embodiment, the indoor unit assembly 12 may be an air handler. In another embodiment, the indoor unit assembly 12 may be a furnace in combination with an evaporator coil. In one embodiment, the outdoor unit assembly 14 may be an air conditioner. In another embodiment, the outdoor unit assembly may be a heat pump.

Figure 2:
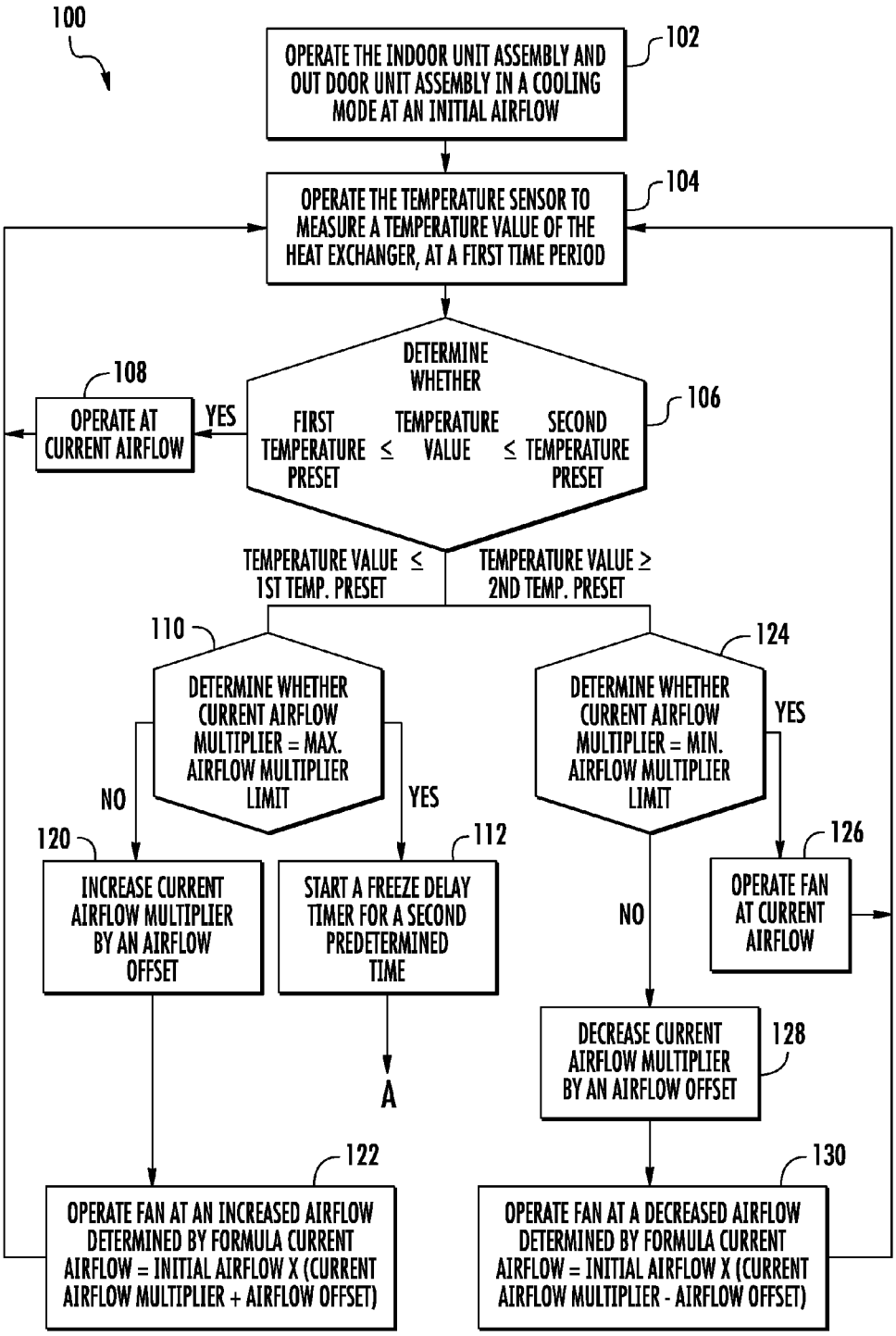
FIG. 2 is a schematic flow diagram of a method for heat exchanger freeze protection for an HVAC system.
Figure 3:
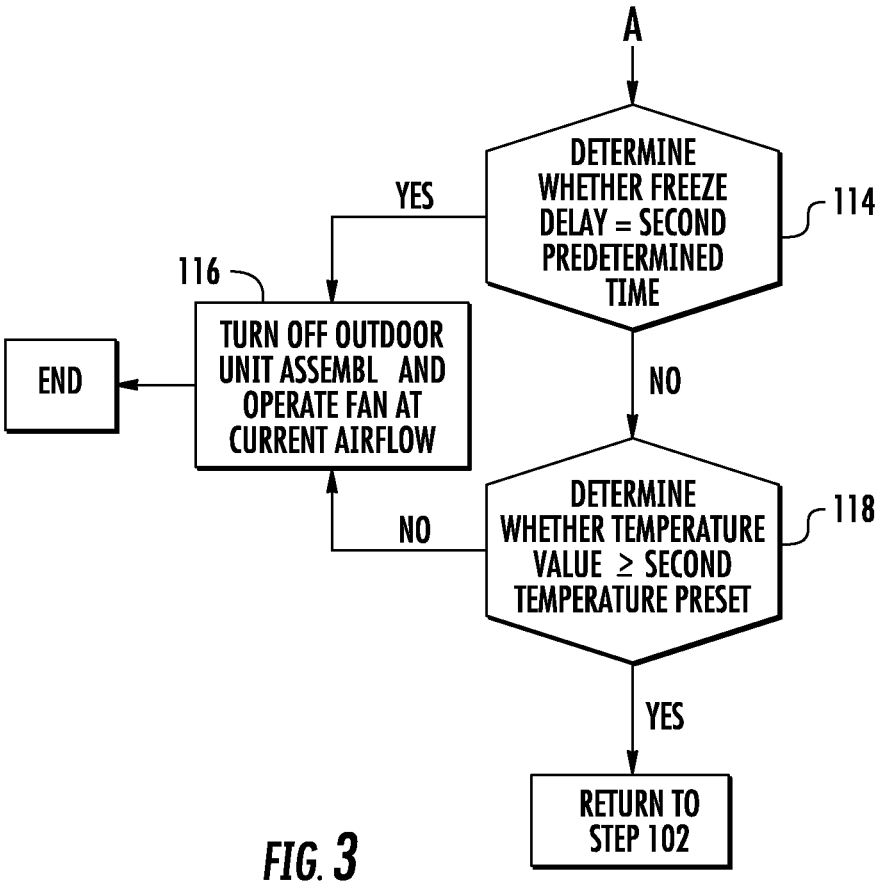
FIG. 3 is a continuation of the schematic flow diagram of the method for heat exchanger freeze protection for an HVAC system.

FIG. 2 illustrates a schematic flow diagram of an exemplary method 100 of heat exchanger freeze protection for an HVAC system 10. The method 100 includes the step 102 of operating the indoor unit assembly 12 and the outdoor unit assembly 14 in a cooling mode, and operating the fan 28 at an initial airflow. For example, the outdoor unit assembly 14 is configured to circulate a refrigerant from the outdoor unit assembly 14, through the liquid line 16. The refrigerant enters the heat exchanger 22 through the liquid port 26 and exits through the suction port 24 where it enters the suction line 16 and returns to the outdoor unit assembly 14. As the low pressure, low temperature refrigerant flows through the heat exchanger 22, the fan 28 operates at an initial airflow to distribute chilled air within the interior space 30. It will be appreciated that any medium used to reduce a temperature of the heat exchanger 22 may be used, such as chilled water to name one non-limiting example.

In one embodiment, the method 100 includes step 104 of operating the temperature sensor 32 to measure a temperature value of the heat exchanger 22, at the expiration of a first predetermined time period. In one embodiment, the first predetermined time period is adjustable. In one embodiment, the first predetermined time period is less than or equal to approximately five minutes. For example, at every five minute interval, the temperature sensor 32 measures the temperature on the suction port 24 as the low pressure, low temperature refrigerant enters the heat exchanger 22; then, the controller 20 reads the temperature value from the temperature sensor 32. The temperature sensor 32 will continue to measure the temperature on the suction port 24 and the controller 20 will continue to read the temperature value at every five minute interval.

In one embodiment, the method 100 includes step 106 of determining whether the temperature value is greater than or equal to a first temperature preset value and less than or equal to a second temperature preset value. In one embodiment, the first temperature preset value and the second temperature preset are adjustable. In one embodiment, the first temperature preset value is less than or equal to approximately 35 degrees F. In one embodiment, the second temperature preset value is greater than or equal to approximately 37 degrees F. If the temperature value is greater than or equal to the first temperature preset value and less than or equal to the second temperature preset value, the method 100 proceeds to step 108 of operating the fan 28 at the current airflow rate. For example, during the beginning of a cooling mode operation, the fan 28 may operate at an initial airflow of approximately 1000 CFM. If the temperature value at the suction port 24 measures approximately 36 degrees F., the fan 28 will continue to operate at the current airflow rate of approximately 1000 CFM.

In one embodiment, to reduce the likelihood of the heat exchanger 22 freezing if the temperature value is less than the first temperature preset, the method 100 proceeds to step 110 of determining whether a current airflow multiplier is equal to a maximum airflow multiplier limit. The current airflow multiplier is a factor in which the initial airflow may be increased or decreased to circulate more or less air across the heat exchanger 22. In one embodiment, the maximum airflow multiplier limit is adjustable. In one embodiment, the maximum airflow multiplier limit is greater than or equal to approximately 1.50. For example, during the beginning of a cooling mode operation, the current airflow multiplier may be equal to 1.00, which designates that the fan 28 operates at the initial airflow. It will be appreciated that the current airflow multiplier is reset to 1.00 at the beginning of each cooling cycle. If the temperature sensor 32 measures and the controller 20 reads a temperature value of 34 degrees F., the controller 20 determines whether the current airflow multiplier (e.g. 1.00) is equal to the maximum airflow multiplier limit (e.g. 1.50). If the current airflow multiplier is equal to the maximum airflow multiplier, the maximum amount of air that may be circulated across the heat exchanger 22 has been achieved, and the method 100 proceeds to step 112 of operating the controller 20 to start a freeze delay timer. Then, method 100 proceeds to step 114 of operating the controller to determine whether the freeze delay timer is equal to a second predetermined time. In one embodiment, the second predetermined time is adjustable. In one embodiment, the second predetermined time is approximately sixty minutes. For example, if the maximum airflow multiplier has been reached, a freezing condition has occurred. The controller 20 starts a freeze delay timer to allow for conditions of the heat exchanger 22 to improve to return to normal operation.

If the freeze delay timer is equal to the second predetermined time, the method 100 proceeds to step 116, wherein the controller 20 commands the outdoor unit assembly 14 to stop operating in the cooling mode and commands the fan 28 to operate at the current airflow. Commanding the outdoor unit assembly 14 to stop operating in the cooling mode stops the refrigerant from flowing through the heat exchanger 22. Continuing operation of the fan 28 allows warmer air to flow across the heat exchanger 22; thus, raising the temperature of the heat exchanger 22. It will be appreciated that a signal may be shown on the controller 20 to alert a user that the outdoor unit assembly 14 has stopped operating in a cooling mode.

If the freeze delay timer is not equal to the second predetermined time, the method 100 proceeds to step 118 of determining whether the temperature value is greater than or equal to the second temperature preset. If the temperature value is less than the second temperature preset, the method 100 proceeds to step 116, wherein the controller 20 commands the outdoor unit assembly 14 to stop operating in the cooling mode and commands the fan 28 to operate at the current airflow. If the temperature value is greater than or equal to the second temperature preset, the method 100 returns to step 102 of operating the indoor unit assembly 12 and the outdoor unit assembly 14 in a cooling mode, and operating the fan 28 at an initial airflow. For example, if the continuing operation of the fan 28 increases the temperature such that equals or surpasses 37 degrees F., the condition of the heat exchanger 22 is such that a cooling operation may resume.

If the current airflow multiplier is not equal to the maximum air flow multiplier, the method 100 proceeds to step 120 of increasing the current airflow multiplier by an airflow offset. The airflow offset is a factor in which the current airflow multiplier may be increased or decreased. In one embodiment, the airflow offset is adjustable. In one embodiment, the airflow offset is approximately 0.05. For example, after the temperature sensor 32 measured and the controller 20 read a temperature value of 34 degrees F., and the controller 20 determined the current airflow multiplier was not equal to the maximum airflow multiplier limit, the current airflow multiplier may be increased by the airflow offset (e.g. 1.00+0.05=1.05) to move more air across the heat exchanger 22.

After the current airflow multiplier has been increased by the airflow offset, the method 100 proceeds to step 122 of operating the fan 28 at an increased airflow determined by the formula:

$$\text{Current Airflow}=\text{Initial airflow}\times(\text{Current airflow multiplier}+\text{airflow offset})$$

For example, after temperature sensor 32 measured and the controller 20 read a temperature value of 34 degrees F., and the controller 20 determined the current airflow was not equal to the maximum airflow multiplier limit, and the current airflow multiplier was increased by the offset airflow factor (e.g. 1.00+0.05=1.05), the controller 20 commands the fan 28 to operate at an increased airflow of 1000 CFM×1.05, or 1050 CFM to circulate more air across the heat exchanger 22; thus, increasing the temperature of the heat exchanger 22 to reduce the likelihood of freezing the heat exchanger 22.

After the current airflow is increased, the method returns to step 104 where the temperature sensor 32 measures the temperature value of the heat exchanger at the expiration of the predetermined time period. For example, after the fan 28 increases the current airflow to 1050 CFM, the temperature sensor 32 will again measure the temperature of the suction port 24 at the five minute interval. It will be appreciated that the aforementioned steps will be repeated until the temperature value is greater than or equal to the first temperature preset value or the current airflow multiplier equals the maximum airflow multiplier limit after the expiration of the predetermined time period.

In one embodiment, if the temperature value is greater than the second temperature preset, the method 100 proceeds to step 124 of determining whether the current airflow multiplier is equal to a minimum airflow multiplier limit. In one embodiment, the minimum airflow multiplier limit is adjustable. In one embodiment, the minimum airflow multiplier limit is less than or equal to approximately 1.00. Continuing from the prior example where the current airflow multiplier is equal to 1.05 causing more air to circulate over the heat exchanger 22; thus, increasing the temperature of the heat exchanger 22, if the temperature sensor 32 measures and the controller 20 reads a temperature value of 38 degrees F., the controller 20 determines whether the current airflow multiplier (e.g. 1.05) is equal to the minimum airflow multiplier limit (e.g. 1.00). If the current airflow multiplier is equal to the minimum airflow multiplier, the minimum amount of air that may be circulated across the heat exchanger 22 to provide efficient operation of the HVAC system 10 has been achieved, and the method 100 proceeds to step 126 wherein the controller 20 commands the fan 28 to operate at the current airflow. The fan 28 will continue to operate at the current airflow until the temperature value may drop again below the second temperature preset.

If the current airflow multiplier is not equal to the minimum air flow multiplier, the method 100 proceeds to step 128 of decreasing the current airflow multiplier by the airflow offset. For example, after temperature sensor 32 measured and the controller 20 read a temperature value of 38 degrees F., and the controller 20 determined the current airflow multiplier was not equal to the minimum airflow multiplier limit, the current airflow multiplier may be decreased by the airflow offset (e.g. 1.05−0.05=1.00) to move less air across the heat exchanger 22.

After the current airflow multiplier has been decreased by the offset airflow factor, the method 100 proceeds to step 130 of operating the fan 28 at a decreased airflow determined by the formula:

$$\text{Current Airflow}=\text{Initial airflow}\times(\text{Current airflow multiplier}-\text{airflow offset})$$

For example, after temperature sensor 32 measured and the controller 20 read a temperature value of 38 degrees F., and the controller 20 determined the current airflow multiplier was not equal to the minimum airflow multiplier limit, and the current airflow multiplier was decreased by the airflow offset (e.g. 1.05−0.05=1.00), the controller 20 commands the fan 28 to operate at a decreased airflow of 1000 CFM×1.00, or 1000 CFM to circulate less air across the heat exchanger 22; thus, decreasing the temperature of the heat exchanger 22 to provide more efficient operation of the HVAC system 10.

After the current airflow is decreased, or left unchanged, the method returns to step 104 where the temperature sensor 32 measures the temperature value of the heat exchanger 22 at the expiration of the predetermined time period. For example, after the fan 28 decreases the current airflow to 1000 CFM, the temperature sensor 32 will again measure the temperature of the suction port 24 at the five minute interval. It will be appreciated that the aforementioned steps will be repeated until the temperature value is less than or equal to the second temperature preset value or the current airflow multiplier equals the minimum airflow multiplier limit after the expiration of the predetermined time period.

It will therefore be appreciated that the controller 20 may command the fan 28 to circulate more or less air across the heat exchanger 22 based upon the temperature value of the suction port 24 of the heat exchanger 22 during a cooling mode.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A method of heat exchanger freeze protection for an HVAC system, the HVAC system including an indoor unit assembly further including a heat exchanger including a suction port and a liquid port, a fan, and a temperature sensor operably coupled to the heat exchanger; an outdoor unit assembly operably coupled to the indoor unit assembly, and a controller operably coupled to the indoor unit assembly and the outdoor unit assembly, the method comprising the steps of:

(a) operating the indoor unit assembly and the outdoor unit assembly in a cooling mode, and operating the fan at an initial airflow;

(b) operating the temperature sensor to measure a temperature value of the heat exchanger, upon expiration of a predetermined time period;

(c) determining whether the temperature value is less than or equal to a first temperature preset value;

(d) operating the controller to increase a current airflow multiplier by an airflow offset if the current airflow multiplier is less than a maximum airflow multiplier limit and the temperature value is less than or equal to the first temperature preset value;

(e) operating the fan at an increased airflow determined by the formula:

Current airflow=Initial airflow×(Current airflow multiplier+airflow offset).

2. The method of claim 1, wherein the indoor unit assembly is selected from a group consisting of: an air handler and a furnace in combination with an evaporator coil.

3. The method of claim 1, wherein the temperature sensor is affixed on the suction port.

4. The method of claim 1, wherein the predetermined time period is adjustable.

5. The method of claim 4, wherein the predetermined time period is less than or equal to approximately 5 minutes.

6. The method of claim 1, wherein the first temperature preset value is adjustable.

7. The method of claim 6, wherein the first temperature preset value is less than or equal to approximately 35 degrees F.

8. The method of claim 1, wherein step (c) further comprises determining whether the temperature value is greater than or equal to a second temperature preset value.

9. The method of claim 8, further comprising determining whether the current airflow multiplier is equal to the maximum airflow multiplier limit.

10. The method of claim 9, further comprising determining whether the current airflow multiplier is equal to a minimum airflow multiplier limit.

11. The method of claim 8, wherein the second temperature preset value is adjustable.

12. The method of claim 11, wherein the second temperature preset value is greater than or equal to approximately 37 degrees F.

13. The method of claim 1, wherein the maximum airflow multiplier limit is adjustable.

14. The method of claim 13, wherein the maximum airflow multiplier limit is greater than or equal to approximately 1.50.

15. The method of claim 10, wherein the minimum airflow multiplier limit airflow is adjustable.

16. The method of claim 15, wherein the minimum airflow multiplier limit is less than or equal to approximately 1.00.

17. The method of claim 1, wherein step (d) further comprises operating the controller to decrease the current airflow multiplier by the airflow offset if the current airflow multiplier is greater than the minimum airflow multiplier limit and the temperature value is greater than or equal to the second temperature preset value.

18. The method of claim 1, wherein step (e) further comprises operating the fan at a decreased airflow determined by the formula:

Current airflow=Initial airflow×(Current airflow multiplier−airflow offset).

19. The method of claim 1, wherein the airflow offset is adjustable.

20. The method of claim 19, wherein the airflow offset is approximately 0.05.

21. The method of claim 9 further comprising operating the controller to start a freeze delay timer.

22. The method of claim 21, further comprising operating the controller to determine if the freeze delay timer is equal to a second predetermined time.

23. The method of claim 22, wherein the second predetermined time is adjustable.

24. The method of claim 23 wherein the second predetermined time is approximately sixty minutes.

25. An HVAC system comprising:

a controller;

an outdoor unit assembly; and an indoor unit assembly comprising:

a heat exchanger including a suction port and a liquid port;

a fan;

a temperature sensor operably coupled to the heat exchanger;

wherein the controller is operably coupled to the indoor unit assembly and the outdoor unit; and wherein the controller is configured to:

(a) operate the indoor unit assembly and the outdoor unit assembly in a cooling mode and operate the fan at an initial airflow;

(b) operate the temperature sensor to measure a temperature value of the heat exchanger, upon expiration of a first predetermined time period;

(c) determine whether the temperature value is less than or equal to a first temperature preset value;

(d) increase a current airflow multiplier by an airflow offset if the current airflow multiplier is less than a maximum airflow multiplier limit and the temperature value is less than or equal to the first temperature preset value; and (e) operate the fan at an increased airflow determined by the formula:

Current airflow=Initial airflow×(Current airflow multiplier+airflow offset).

26. The HVAC system of claim 25, wherein the indoor unit assembly is selected from a group consisting of: an air handler and a furnace in combination with an evaporator coil.

27. The HVAC system of claim 25, wherein the outdoor unit assembly is selected from a group consisting of: an air conditioner, and a heat pump.

28. The HVAC system of claim 25, wherein the temperature sensor is affixed to the suction port.

29. The HVAC system of claim 25, wherein the first predetermined time period is adjustable.

30. The HVAC system of claim 29, wherein the first predetermined time period is less than or equal to approximately 5 minutes.

31. The HVAC system of claim 25, wherein the first temperature preset value is adjustable.

32. The HVAC system of claim 31, wherein the first temperature preset value is less than or equal to approximately 35 degrees F.

33. The HVAC system of claim 25, wherein the controller is further configured to determine whether the temperature value is greater than or equal to a second temperature preset value in step (c).

34. The HVAC system of claim 33, wherein the controller is further configured to determine whether the current airflow multiplier is equal to the maximum airflow multiplier limit.

35. The HVAC system of claim 34, wherein the controller is further configured to determine whether the current airflow multiplier is equal to a minimum airflow multiplier limit.

36. The HVAC system of claim 33, wherein the second temperature preset value is adjustable.

37. The HVAC system of claim 36, wherein the second temperature preset value is greater than or equal to approximately 37 degrees F.

38. The HVAC system of claim 25, wherein the maximum airflow multiplier limit is adjustable.

39. The HVAC system of claim 38, wherein the maximum airflow multiplier limit is greater than or equal to approximately 1.50.

40. The HVAC system of claim 35, wherein the minimum airflow multiplier limit airflow is adjustable.

41. The HVAC system of claim 40, wherein the minimum airflow multiplier limit is less than or equal to approximately 1.00.

42. The HVAC system of claim 25, wherein the controller is further configured to decrease the current airflow multiplier by the airflow offset if the current airflow multiplier is greater than the minimum airflow multiplier limit and the temperature value is greater than or equal to the second temperature preset in step (d).

43. The HVAC system of claim 25, wherein the controller is configured to operate the fan at a decreased airflow, in step (e), determined by the formula:

$$\text{Current airflow} = \text{Initial airflow} \times (\text{Current airflow multiplier} - \text{airflow offset}).$$

44. The HVAC system of claim 25, wherein the airflow offset is adjustable.

45. The HVAC system of claim 44, wherein the airflow offset is approximately 0.05.

46. The HVAC system of claim 34, wherein the controller is further configured to start a freeze delay timer.

47. The HVAC system of claim 46, wherein the controller is further configured to determine if the freeze delay timer is equal to a second predetermined time.

48. The HVAC system of claim 47, wherein the second predetermined time is adjustable.

49. The HVAC system of claim 48, wherein the second predetermined time is approximately sixty minutes.

* * * * *